US006233842B1

(12) United States Patent
Geelen

(10) Patent No.: US 6,233,842 B1
(45) Date of Patent: May 22, 2001

(54) METHOD FOR OPERATING A DRYING DEVICE

(75) Inventor: Pierre Marie Lambért Geelen, Haelen (NL)

(73) Assignee: Geelen Techniek B.V. (NL)

( * ) Notice: Subject to any disclaimer, the term of this patent is extended or adjusted under 35 U.S.C. 154(b) by 0 days.

(21) Appl. No.: 09/402,500

(22) PCT Filed: Mar. 27, 1998

(86) PCT No.: PCT/NL98/00173

§ 371 Date: Oct. 4, 1999

§ 102(e) Date: Oct. 4, 1999

(87) PCT Pub. No.: WO98/45655

PCT Pub. Date: Oct. 15, 1998

(30) Foreign Application Priority Data

Apr. 4, 1997 (NL) ..... 1005728

(51) Int. Cl.[7] ..... F26B 7/00

(52) U.S. Cl. ..... 34/360; 34/370; 34/483; 34/484; 34/485; 34/491

(58) Field of Search ..... 34/359, 360, 370, 34/482, 483, 484, 485, 491, 495; 426/233

(56) References Cited

U.S. PATENT DOCUMENTS 4,633,593 * 1/1987 Wallis ..... 34/484
4,750,273 * 6/1988 Parkes et al. ..... 34/484
5,637,336 * 6/1997 Kannenberg et al. ..... 426/231

FOREIGN PATENT DOCUMENTS 125362 11/1901 (DE) .
36.070 4/1930 (FR) .
865.394 5/1941 (FR) .
903.275 9/1945 (FR) .
1.069.606 7/1954 (FR) .

* cited by examiner

*Primary Examiner*—Pamela Wilson
(74) *Attorney, Agent, or Firm*—Skjerven Morrill MacPherson LLP; Alan H. MacPherson

(57) ABSTRACT

A method for operating a drying device which includes at least two chambers provided with bottoms for bulk material to be dried, and a means for supplying and discharging a gaseous medium to and from each chamber and wherein the bulk material is partially dried by the gaseous medium and is then transported from a first to a second chamber. The energy increase brought about by the energy supplied to the chamber by the gaseous medium, and the energy given out by the bulk material is determined for each chamber, after which the amount of moisture that has evaporated from the bulk material is determined on the basis of the energy increase and the amount of moisture expected to be present in the bulk material discharged from the device is determined on the basis of the difference between the amount of moisture present in the bulk material introduced into the device and the amount of moisture that has evaporated.

12 Claims, 3 Drawing Sheets

METHOD FOR OPERATING A DRYING DEVICE

The invention relates to a method for operating a drying device comprising at least two chambers provided with bottoms for bulk material to be dried, and means for supplying to each chamber and discharging from each chamber a gaseous medium, wherein the bulk material, after being partially dried by means of said gaseous medium, is transported from a first chamber to a second chamber.

The invention also relates to a device which is suitable for carrying out such a method.

With a similar method, which is known from German patent No. 379,730, air is passed through a number of chambers lying one above the other, whereby bulk material present on the bottom of said chambers is dried. The bulk material is introduced into the device via an uppermost chamber, and it is successively passed through the bottom of a chamber and deposited on the bottom of the chamber present thereunder. With the known method, the temperature of the inflowing air is controlled. In order to achieve a desired drying effect with regard to the bulk material that has been introduced into the drying device, the moisture content of the bulk material must be determined after drying, after which the temperature of the gaseous medium being supplied must be changed, if necessary. This procedure must be repeated until the bulk material has the desired moisture content.

During the period of time that the moisture content of the dried bulk material is being determined, there is a risk that the bulk material emanating from the device will be relatively too dry or too moist. The latter is undesirable, of course, because this means that the bulk material is delivered which does not have the desired moisture content.

When bulk material, such as cattle feed, pet food, etc., is being dried, the percentage of moisture which eventually remains behind in the bulk material must stay within predetermined limits. If too much moisture remains behind, this may lead to decay of the bulk material. If the bulk material is too dry, more energy has been used for drying than is necessary, which is energetically and thus economically inefficient. In the case of fish feed the moisture content also determines the floating or sinking capacity of the fish feed.

In addition to the above drawbacks of the method known from said German patent, such a method is furthermore unsuitable when the bulk material to be dried is changed regularly, because the period of time that is required for determining the desired air temperature, is often longer than the period of time during which a predetermined amount of bulk material is dried.

The object of the invention is to provide a method wherein bulk material is dried to a desired moisture content in a relatively simple manner.

This objective is accomplished with the method according to the invention in that the energy increase brought about by the energy supplied to the chamber by means of the gaseous medium and the energy given out by the bulk material, is determined for each chamber, after which the amount of moisture that has evaporated from the bulk material is determined on the basis of said energy increase, after which the amount of moisture expected to be present in the bulk material discharged from the device is determined on the basis of the difference between the amount of moisture present in the bulk material introduced into the device and the amount of moisture that has evaporated.

With such a method, the amount of moisture contained in the bulk material present in each chamber is known. If the amount of moisture that is calculated to have evaporated from the bulk material present in a chamber deviates from the desired amount of moisture that has evaporated, the degree to which drying takes place can be directly adapted. Such a method may be used with a number of chambers disposed one above the other, whereby the bottom of one chamber forms the ceiling of a chamber present thereunder. It is also possible, however, to use the method with bulk material that is transported by means of an elongated conveyor belt, whereby the conveyor belt extends through a number of chambers lying side by side and whereby the conveyor belt is passed through said chambers in steps.

It is noted that a continuously moving conveyor belt, which transports bulk material, is known per se, whereby air is passed through the conveyor belt.

One drawback of such a conveyor belt is the fact that the moisture content of the bulk material can only be determined afterwards.

The invention will be explained in more detail hereafter with reference to the drawing, in which.

Corresponding parts are indicated by the same numerals in the figures.

Figure 1:
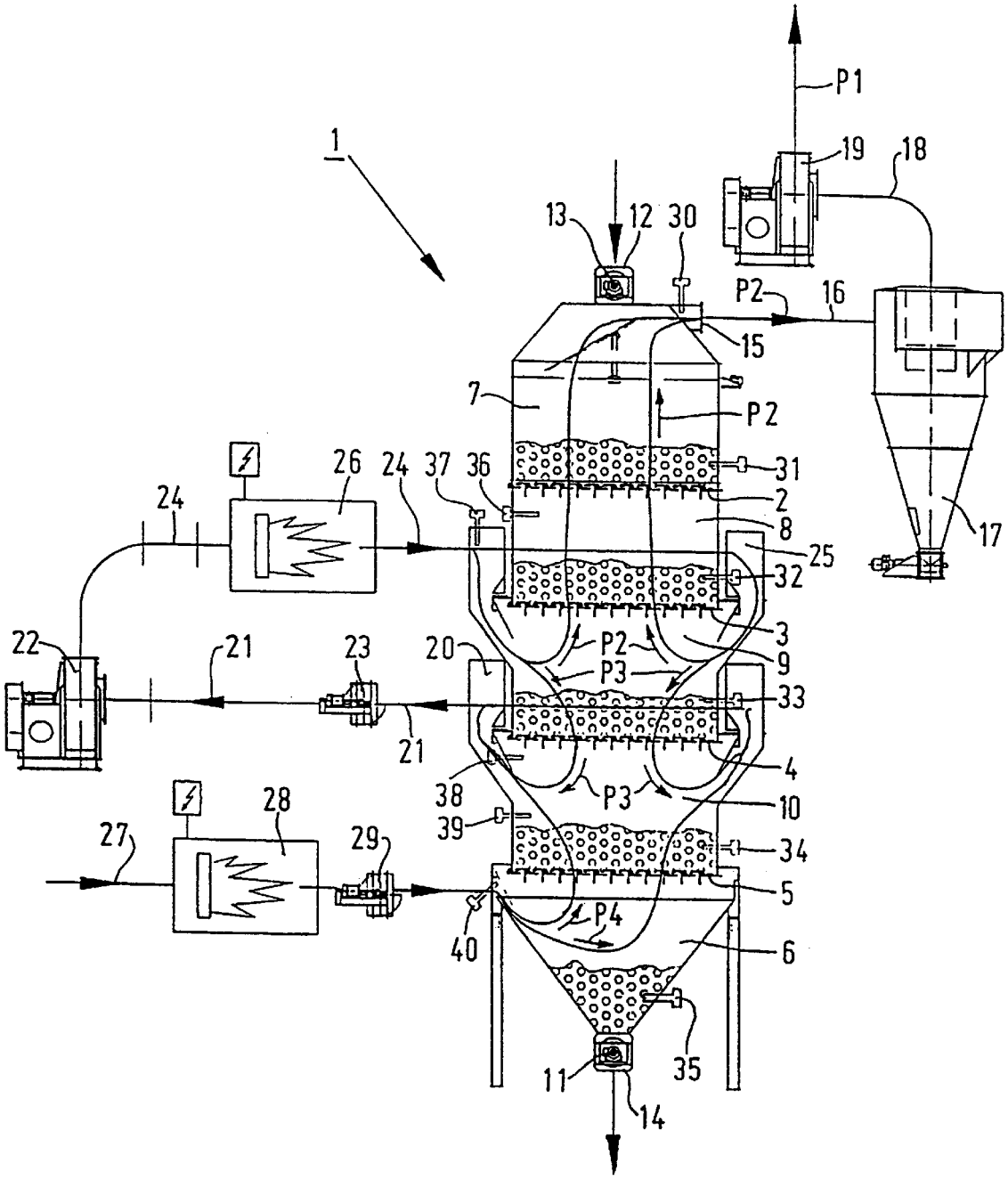
FIG. 1 is a diagrammatic cross-section of a device according to the invention.

The device which is shown in FIG. 1 comprises a housing 1, in which a number of chambers 7–10, which are separated from each other by bottoms 2–5, are disposed one above the other. Said bottoms are provided with a large number of openings, in a similar manner as for example described and illustrated in the aforesaid patent, which openings can be closed by means of adjustable valves, all this in such a manner that when the valves are adjusted from a position in which the openings are closed to a position in which the openings are released, bulk material present on a bottom, for example cereals, cattle feed or similar granular material, can fall through the openings in the respective bottom onto a bottom present thereunder.

Connected to the upper side of the housing is a supply pipe 12 bounding an inlet passage, in which a lock means, for example a cell wheel lock 13, is accommodated.

In a similar manner, a discharge pipe 14 bounding an outlet passage, which accommodates a lock means, for example a cell wheel lock 11, is on the underside of housing 1 connected to a conically extending space 6 present under bottom 5.

By using the lock means, the bulk material can be supplied to housing 1 or be discharged therefrom without this causing an undesirable inflow of ambient air into the housing or an outflow of air from the housing when bulk material is respectively supplied to the housing and discharged therefrom.

A discharge branch 15 is provided at the upper end of housing 1 for discharging a gaseous medium, for example air, from housing 1, which air is supplied to a dust extraction cyclone 17 via a pipe 16. A fan 19 is connected to cyclone 17, via a pipe 18, for drawing in air from housing 1, via which fan the air drawn in from housing 1 is exhausted into the atmosphere in a direction indicated by arrow P1.

Chamber 10 is connected to a fan 22 via a pipe 21 and a pipe 20 present between bottoms 4 and 5, which fan draws in air from chamber 10. An adjustable valve 23 is mounted in pipe 21, by means of which the amount of air drawn in by fan 22 per unit tine can be controlled.

The discharge side of fan 22 is connected to chamber 9 via a pipe 24 and a pipe 25 present between bottoms 3 and 4. A heating element 26 is disposed in pipe 24 for heating the air transported by pipe 24.

A pipe 27 is connected to housing 1 of the drying device, at a point located under bottom 5. Air is drawn into chamber 11, via pipe 27, by means of fan 22. Pipe 27 is fitted with a heating element 28 for heating the air that is introduced into housing 1, and also with an adjustable control valve 29, by means of which the amount of air that is supplied via pipe 27 per unit time can be controlled.

An air temperature sensor 30 is provided near discharge branch 15, bulk material temperature sensors 31, 32, 33, 34, 35 are disposed at a small distance from bottoms 2, 3, 4, 5 and lock means 11 respectively, an air temperature sensor 36 is disposed between bottoms 2 and 3, an air temperature sensor 37 is disposed between bottoms 3, 4, two air temperature sensors 38, 39 are disposed one above the other between bottoms 4, 5, and a temperature sensor 40 is disposed under bottom 5.

During operation of the device bulk material to be dried will be introduced into the interior of housing 1 in portions via the lock means 13 provided in supply pipe 12, and be deposited on the uppermost bottom 2, and then successively on the bottoms present thereunder. To this end the openings in the bottoms disposed one above the other are opened at regular intervals, starting with the lowermost bottom 5, and then in succession from the bottom to the top in bottoms 4, 3, 2.

During operation of the device, part of the air being supplied via pipe 24 and heated by means of heating device 26 will flow through the two upper bottoms 2 and 3 in a direction indicated by arrow P2, and be discharged via extraction cyclone 17 and fan 19. Another part of the air supplied via pipe 24 will flow via pipe 21 through the bulk material present on bottom 4, in a direction indicated by arrow P3, to fan 22 under the influence of the sucking action of fan 22, and be introduced into the interior of housing 1 again via pipe 24. The air that is supplied via pipe 27 will flow through the bulk material present on bottom 5, in a direction indicated by arrow P4, under the influence of the sucking action of fan 22, and subsequently flow to fan 22 via pipe 21, from where it will be introduced into the interior of housing 1 of the device again via pipe 24.

In order to be able to determine the temperature changes of the air that flows downwards through bottom 4 and of the air that flows upwards through the bottom 5 directly thereunder as accurately as possible, two temperature sensors 38 and 39 are disposed one above the other between said bottoms 4 and 5, whereby the upper sensor 38 measures the temperature of the air flowing in through bottom 4, and sensor 39 measures the temperature of the air flowing in through bottom 5.

By controlling the valves 23 and 29 it becomes possible to maintain the amount of air that flows through the device per unit time at a desired level. The device is provided with means (not shown) for measuring the amount of air that flows through pipes 21, 27 per unit time.

The temperature of the air above and under each of the bottoms 2–5 can be measured by means of air temperature sensors 30, 36–40. The amount of energy that is absorbed in a chamber 7–10 can be determined on the basis of the difference in air temperature under and above a bottom and the amount of air flowing through per unit time.

The data from the various temperature sensors 30–40, as well as data with regard to the volume of the air flowing through the device per unit time, data with regard to the amount or the volume of the bulk material supplied to the device via supply pipe 12, and the data with regard to the moisture content of the bulk material being supplied to the device are fed to a control unit (not shown), for example a computer, by means of which the moisture content of the bulk material present on the various bottoms can be calculated, in dependence on which calculation the amount of air and the temperature of the air being supplied via pipes 24 and 27 are controlled, all this in such a manner that, the bulk material that exits the device has the desired moisture content and the desired temperature, whilst an optimum through-flow of the bulk material through the device is effected.

Below a detailed description of the method according to the invention will be given.

In first chamber 7 the amount of bulk material to be dried, which has been deposited on bottom 2 via lock 13, is determined. The amount of moisture present in the bulk material that has been introduced into chamber 7 is determined, for example on the basis of the processes to which the bulk material has been subjected before being supplied to the device. The amount of moisture, for example per unit weight, which the bulk material is allowed to contain after drying is stored in the control unit. Then the difference between the amount of moisture which the bulk material introduced into chamber 7 contains before drying and the amount that may be present in said bulk material after drying is determined. This difference is a measure for the amount of moisture to be extracted from the bulk material. The amount of moisture to be extracted, and the number of chambers, determine how much moisture is to be extracted per chamber. The moisture will be extracted from the bulk material by evaporation, and the amount of energy that is needed for evaporating a specified amount of moisture is known in physics. The moisture, for example water, has an evaporation heat Vw (kJ/kg) which determines the amount of energy (kJ) which is needed for evaporating 1 kg of water. The temperature of the gaseous medium, for example air, that is passed through a bottom and through the bulk material present thereon decreases, as a result of which said medium gives out energy to the bulk material, which energy is used either for heating the bulk material, or for evaporating the moisture present in the bulk material. The amount of energy which the air gives out depends on the amount of air $M_l$, which is passed through the bulk material for a predetermined period of time, the input temperature and the output temperature $T_{l.in}$, $T_{l.out}$ of the air and the specific heat $Cw_l$ of the air. Accordingly, the energy $E_l$ given out by the air is:

$$E_l = M_l.(T_{l.in} - T_{l.out}).Cw_l$$

The temperature $T_{s.out}$ of the bulk material, which had a specified value $T_{s.in}$ upon being introduced into chamber 7, may increase or decrease. The bulk material thereby absorbs or gives out energy. This energy $E_s$ can be determined on the basis of the temperature change, the mass $M_s$ of the bulk material, and the specific heat $Cw_s$ of the bulk material, and it equals:

$$E_s = M_s.(T_{s.in} - T_{s.out}).Cw_s$$

Energy $E_l$ and $E_s$ are thereby defined such that the energy given out to the chamber will be positive in the case of a temperature decrease. Consequently, the energy $E_v$ given out to the chamber by the air flow and the bulk material, which energy is available for evaporating the moisture present in the bulk material, equals $$E_v = E_l + E_s$$

The amount of moisture $M_v$ that is evaporated by means of said energy $E_v$ equals $$M_v = E_v / VW_v,$$

wherein $Vw_v$ is the evaporation heat of the moisture to be evaporated.

Consequently the amount of energy $E_v$ that is available for evaporation in a chamber can be calculated on the basis of the above formulas and the input and output temperatures $T_{l.in}$, $T_{s.in}$, $T_{l.out}$, $T_{s.out}$ of the air and the bulk material respectively and the amount of air $M_l$ that has been passed through the bulk material.

The amount of evaporated moisture can be determined at any desired moment by means of the above formulas. The amount of air $M_l$ that is introduced into a chamber and/or the input temperature $T_{l.in}$ of the air that is introduced into a chamber is controlled on the basis of the amount of moisture to be evaporated in a chamber.

Figure 4A:
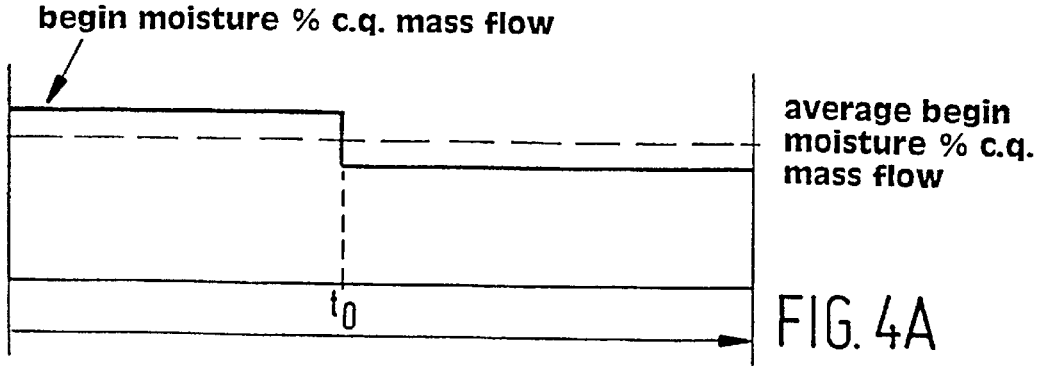
Figure 4B:
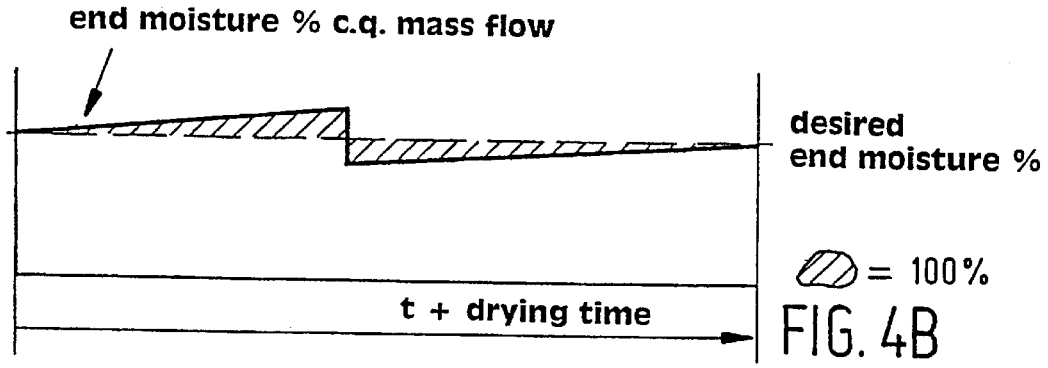
Figure 5A:
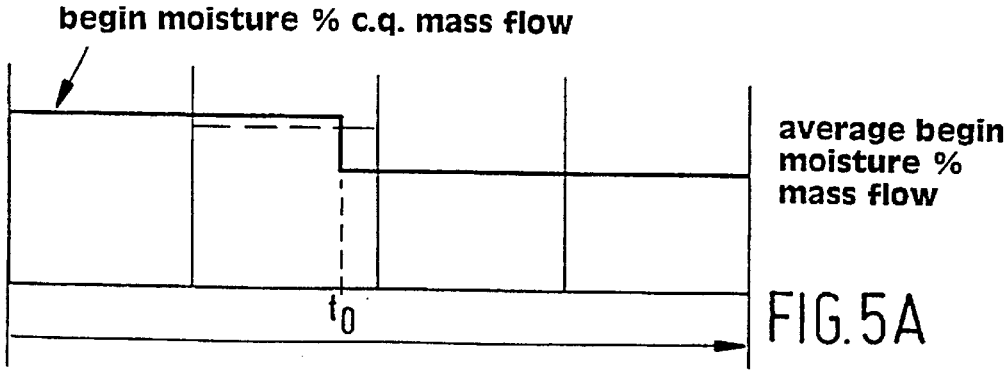
Figure 5B:
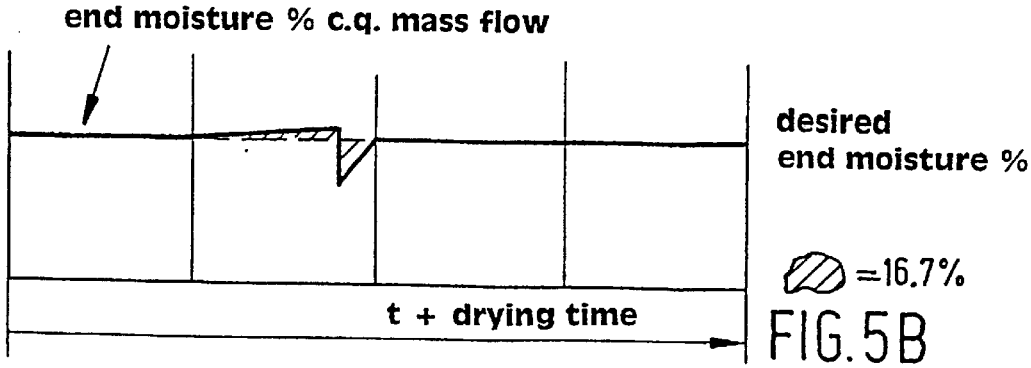

FIGS. 2A–5B show graphs of a drying process of bulk material, which is carried out by means of a conveyor belt which is known per se, whereby air is blown through the conveyor belt over the entire length thereof (FIGS. 2, 4), and of a drying process carried out by using the method according to the invention (FIGS. 3, 5).

The horizontal axis in the graphs represents time, and the vertical axis represents the amount of moisture, whereby FIGS. 2A, 3A, 4A, 5A show the amount of moisture before drying, and FIGS. 2B, 3B, 4B, 5B show the amount of moisture after drying.

Figure 2A:
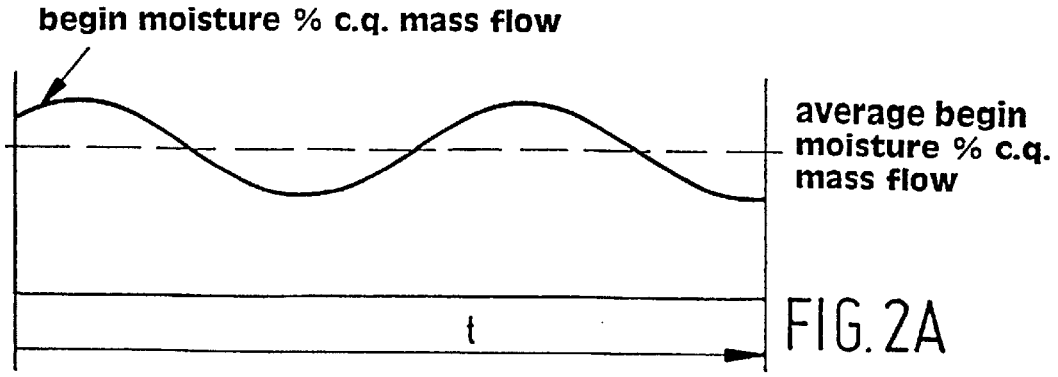
FIGS. 2A–5B show graphs of the method for drying bulk material, wherein FIGS. 2A, 2B, 4A, 4B relate to a continuous conveyor belt which is known per se, whilst FIGS. 3A, 3B and 5A, 5B relate to the method according to the invention.
Figure 2B:
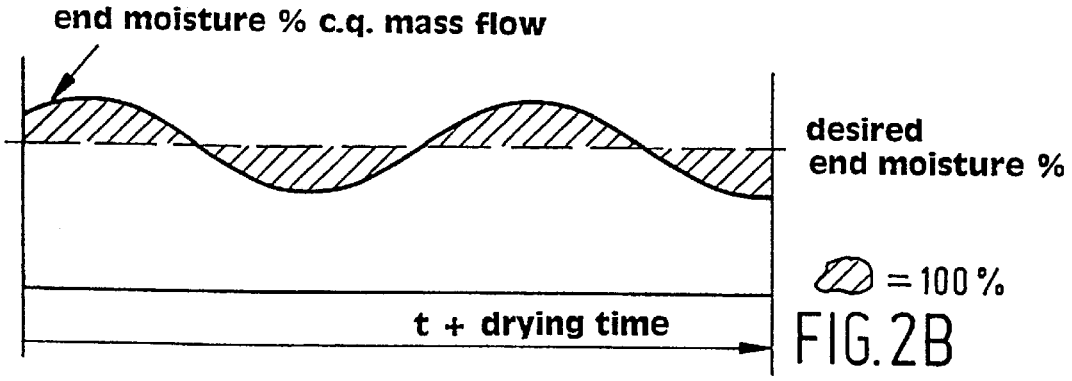

FIGS. 2A and 2B show a situation wherein the amount of moisture which is contained in the bulk material exhibits a sinusoidal variation. In the case of continuous drying, whereby the total amount of bulk material which is present on a conveyor belt is dried at the same temperature and with the same amount of air, said sinusoidal variation in the initial moisture content will also be discernible in the amount of moisture after drying. This is shown in FIG. 2B. The desired final moisture percentage is represented by a horizontal line in FIG. 2B. The area between the actual amount of moisture and the desired amount of moisture is hatched, it is set at 100% in order to be able to make a comparison with the situation when the method according to the invention is used.

Figure 3A:
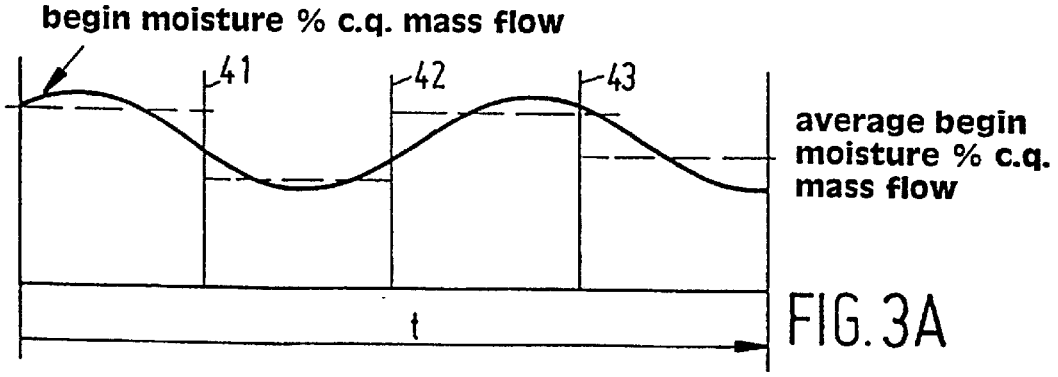
Figure 3B:
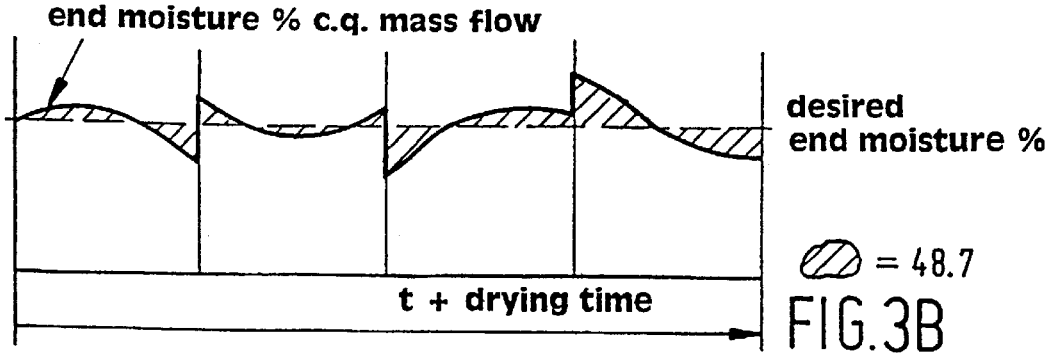

FIGS. 3A and 3B show the situation when using the method according to the invention, wherein bulk material having the same initial moisture content as in the situation shown in FIG. 2A is used. Instead of using a continuous flow of bulk material, the bulk material is divided into separate portions with the method according to the invention, which are successively supplied to the chambers, whereby each portion is dried in a manner which is suitable for that portion. The separation between the various portions is illustrated by vertical lines 41, 42, 43. Each portion is passed through the various chambers 7, 8, 9, 10, whereby each portion is dried to an average desired final moisture content. The variations within one portion as regards the moisture content at inlet 12 will remain present, but the total moisture content of the portion has been brought down to the desired final level. This is shown in FIG. 3B, wherein the hatched area is a measure for the amount of bulk material that does not exhibit the desired moisture content. In the situation which is shown in FIG. 3B, this area corresponds with 48.8% in comparison with the situation that is shown in FIG. 2B.

FIGS. 4A and 5A show a situation wherein there is a stepwise increase in the amount of moisture in the bulk material at point in time $T_o$. In the situation which is shown in FIG. 4B, wherein the bulk material is present on a continuous conveyor belt, the bulk material that was placed on the conveyor belt before point in time $T_o$, will be dried additionally as a result of this higher temperature, as a result of which this bulk material will be dry, whilst the bulk material that was placed on the conveyor belt after $T_O$, and which has a relatively higher moisture content, will only be dried at a desired temperature after some time. Also in this figure, the total amount of bulk material which does not exhibit the desired final moisture content is indicated by the hatched area, which is 100%. In the situation which is shown in FIG. 5B, using the method according to the invention, only one portion is partially too dry and partially too moist. The other portions have precisely the desired final moisture content. The hatched area, which is a measure for the amount of bulk material which exhibits a deviating moisture content, is 16.7%.

From the above figures it will be apparent that the method according to the invention enables a significantly improved control of the moisture changes.

It will be apparent that the invention is not limited to the embodiment which is described above and which is illustrated in the drawing, but that modifications and/or additions thereto are conceivable. Thus, the device may for example comprise more or fewer bottoms than the illustrated embodiment. Furthermore, the chambers may be disposed side by side, whereby the bulk material is transported from one chamber to another by means of a conveyor belt which moves in steps.

It is noted that it is also possible to use a gaseous medium other than air for carrying out the drying process.

What is claimed is:

1. A method for operating a drying device comprising at least a first and a second chamber provided with bottoms for bulk material to be dried, and means for supplying to each chamber and discharging from each chamber a gaseous medium, wherein the bulk material, after being partially dried by means of said gaseous medium, is transported from the first chamber to the second chamber, characterized by providing the gaseous medium to each chamber, the gaseous medium carrying energy into each chamber thereby to cause energy to be given out by said bulk material, determining an energy increase for each chamber brought about by:

the energy supplied to the chamber by means of the gaseous medium and the energy given out by said bulk material, determining the amount of moisture that has evaporated from the bulk material in each chamber on the basis of the energy increase, and determining the amount of moisture expected to be present in the bulk material discharged from the device on the basis of the difference between the amount of moisture present in the bulk material introduced into the device and the sum of the amounts of moisture that has evaporated in said chambers.

2. A method according to claim 1, characterized by:

measuring the temperature of the gaseous medium flowing into the chamber, measuring the temperature of the gaseous medium flowing out of the chamber, measuring the amount of gaseous medium flowing through the chamber, and measuring the temperature of the bulk material, wherein each of said measurements is made at minimally two points in time so as to determine the energy increase.

3. A method according to claim 1, further characterized by;

determining the amount of energy added to a chamber by means of the gaseous medium on the basis of the amount of moisture that has evaporated from the bulk material in said chamber and the predetermined desired amount of moisture to be evaporated from the bulk material in said chamber.

4. A method according to claim 1, further characterized by;

changing the energy supplied to a chamber by changing the temperature of the gaseous medium flowing into the chamber.

5. A method according to claim 1, further characterized by;

passing the gaseous medium at a predetermined temperature through the bulk material in a last chamber, thereby to cause the bulk material to have a predetermined temperature upon being discharged from the drying device.

6. A method according to claim 1, further characterized by;

disposing said chambers one above the other to provide an upper chamber and a lower chamber beneath the upper chamber, and passing the bulk material through openings from the upper chamber into the lower chamber after a predetermined amount of drying, said upper chamber having an uppermost bottom and said lower chamber having a lowermost bottom.

7. A method according to claim 1, further characterized by;

supplying the bulk material to the device at the upper side of the device via an inlet passage comprising a lock means, and discharging said bulk material at the bottom side of the device, via an outlet passage comprising a lock means.

8. A method according to claim 6, further characterized by:

discharging a first portion of the gaseous medium supplied to the device into the atmosphere discharging a second portion of the gaseous medium supplied to the device from the device at a point located between the uppermost bottom and the lowermost bottom, and supplying the second portion of the gaseous medium to the device again, via a heating element, at a point which is located higher than the point at which the second portion of the gaseous medium is discharged from the device.

9. A method according to claim 6, further characterized by:

supplying a heated gaseous medium under the bottom of the lowermost chamber, discharging this gaseous medium at a point located between the bottom of the lowermost chamber and the bottom of the uppermost chamber, and supplying this gaseous medium to the device again, via a heating element, at a point which is located higher than the point at which this gaseous medium was discharged.

10. A method according to claim 1, further characterized by:

providing a chamber located between two bottoms disposed one above the other, supplying a gaseous medium in a downward air flow through the upper one of said two bottoms and in an upward air flow through the lower one of said two bottoms, discharging said gaseous medium from the device; and measuring the temperature of the air of both air flows between said bottoms.

11. A method according to claim 1, further characterized by:

controlling the amount of gaseous medium flowing through the device by means of valves provided in flow passages through which the gaseous medium flows.

12. A method according to claim 1, further characterized by:

changing the energy supplied to a chamber by changing the amount of the gaseous medium flowing through the chamber.

* * * * *